US008275587B2

(12) United States Patent
Sato et al.

(10) Patent No.: US 8,275,587 B2
(45) Date of Patent: Sep. 25, 2012

(54) METHOD FOR DESIGNING GOLF BALL AND GOLF BALL MANUFACTURED BY THE SAME

(75) Inventors: Katsunori Sato, Chichibu (JP); Takuma Nakagawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 530 days.

(21) Appl. No.: 12/608,276

(22) Filed: Oct. 29, 2009

(65) Prior Publication Data

US 2011/0106500 A1 May 5, 2011

(51) Int. Cl.
*G06F 17/10* (2006.01)

(52) U.S. Cl. ..... 703/2; 473/383

(58) Field of Classification Search ..... 703/1, 2, 703/6; 473/371, 383; 264/39
See application file for complete search history.

(56) References Cited

U.S. PATENT DOCUMENTS

| | | | | |
|---|---|---|---|---|
| 6,866,802 | B2 * | 3/2005 | Puniello et al. | 264/39 |
| 2004/0087389 | A1 * | 5/2004 | Kasashima et al. | 473/383 |
| 2005/0020386 | A1 * | 1/2005 | Sasaki | 473/371 |
| 2005/0037865 | A1 * | 2/2005 | Yagley et al. | 473/371 |
| 2008/0058124 | A1 * | 3/2008 | Simonds et al. | 473/383 |
| 2008/0220907 | A1 * | 9/2008 | Aoyama et al. | 473/383 |
| 2010/0075776 | A1 * | 3/2010 | Nardacci et al. | 473/371 |

FOREIGN PATENT DOCUMENTS

| | | | |
|---|---|---|---|
| JP | 2569515 | B2 | 10/1996 |
| JP | 2000-70413 | A | 3/2000 |

* cited by examiner

*Primary Examiner* — Kandasamy Thangavelu
(74) *Attorney, Agent, or Firm* — Sughrue Mion, PLLC

(57) ABSTRACT

A method for manufacturing a golf ball includes the step of designing plural dimples on a surface of the golf ball so as to satisfy the following parameters. A total number N of the dimples is approximately 400 or less; a surface roughness Rda of the golf ball is approximately 0.085 mm or less; and a value obtained by dividing an average convex part surface area Srt in the first cross-section and the second cross-section by an average concave part cross-section Sru in the first cross-section and the second cross-section is approximately 0.9 or less. The golf ball surface roughness Rda is the average value of a first golf ball cross-section surface roughness Rp, a second golf ball cross-section surface roughness Rm, and a third golf ball cross-section surface roughness Rs. The average convex part surface area Srt is the average value of a first convex part surface area Art that, in the first cross-section, is surrounded by the reference spherical surface and the golf ball surface that is higher than the reference spherical surface and a second convex part surface area Art that, in the second cross-section, is surrounded by the reference spherical surface and the golf ball surface that is higher than the reference spherical surface.

4 Claims, 3 Drawing Sheets

METHOD FOR DESIGNING GOLF BALL AND GOLF BALL MANUFACTURED BY THE SAME

BACKGROUND OF THE INVENTION

The present invention relates to a method for designing a golf ball and relates to a golf ball manufactured by the method.

In designing a golf ball, it is widely known that high repulsion of the golf ball itself and reduction of air resistance by disposing dimples on the surface of the golf ball are important in obtaining a long carry distance when the golf ball is struck. A large number of dimples are usually disposed on the surface of a golf ball, and various methods have been proposed for disposing dimples not only at high density, but also uniformly on the surface of the ball for the purpose of reducing the air resistance.

For example, in Japanese Laid-Open Patent Application Publication 2000-70413, there is a disclosure, in a method for designing a golf ball which treats the surface of a golf ball as a spherical icosahedron in which each of the spherical triangular units forming the spherical icosahedron has substantially the same dimple placement, a method for disposing dimples so that dimples that straddle adjacent spherical triangular units exist in a prescribed proportion.

In the conventional dimple design and disposing method, however, although the dimples were disposed uniformly and it was possible to expect an improvement in aerodynamic performance under prescribed conditions called for by the method, because the aerodynamic performance of the golf ball that is ultimately obtained is influenced by the dimple balance in the entirety of the golf ball, it was necessary to achieve the ideal aerodynamic performance by a process of trial-and-error.

SUMMARY OF THE INVENTION

Accordingly, the present invention has as an object to provide a method for designing a golf ball that reduces the air resistance of the golf ball and enables stable carry by effectively disposing dimples on the surface of the golf ball, and to provide a golf ball manufactured by the method.

To achieve the above-noted object, the present invention is a method for manufacturing a golf ball that includes the step of designing plural dimples on a surface of the golf ball so as to satisfy the parameters of: a total number N of the dimples being approximately 400 or less; a surface roughness Rda of the golf ball being approximately 0.085 mm or less, in which the golf ball surface roughness is an average value of a first golf ball cross-section surface roughness Rp, a second golf ball cross-section surface roughness Rm, and a third golf ball cross-section surface roughness Rs, wherein the first cross-section is a cross-section passing through a north pole point and a south pole point of the golf ball and also passing through a center point of a first dimple in proximity to the north pole point or the south pole point, the second cross-section is a cross-section passing through the center of the golf ball, intersecting perpendicularly with the first cross-section, and also intersecting with a cross-section along an equator of the golf ball at an angle of approximately 45 degrees in the direction of the center of the first dimple in proximity to the north pole point or the south pole point, the third cross-section is a cross-section along the equator of the golf ball, and the surface roughnesses Rp, Rm, and Rs are calculated using as a reference a spherical surface that has a radius that is approximately 0.1 mm shorter than a virtual spherical surface having the outermost radius of the golf ball and that shares a common center with the virtual spherical surface; and a value obtained by dividing an average convex part surface area Srt in the first cross-section and the second cross-section by an average concave part cross-section Sru in the first cross-section and the second cross-section being approximately 0.9 or less, wherein the average convex part surface area Srt is the average value of a first convex part surface area Art that, in the first cross-section, is surrounded by the reference spherical surface and the golf ball surface that is higher than the reference spherical surface and a second convex part surface area Art that, in the second cross-section, is surrounded by the reference spherical surface and the golf ball surface that is higher than the reference spherical surface, and the average concave part surface area Sru is the average value of a first concave part surface area Aru that, in the first cross-section, is surrounded by the reference spherical surface and the golf ball surface that is lower than the reference spherical surface and a second concave part surface area Aru that, in the second cross-section, is surrounded by the reference spherical surface and the golf ball surface that is lower than the reference spherical surface.

The designing step can satisfy an additional parameter that the golf ball surface roughness Rda multiplied by the overall number N of the dimples is approximately 26.0 mm-dimples or lower. The designing step can also satisfy an additional parameter that the lift coefficient CL at Re70000/2000 rpm is approximately 70% or more of the lift coefficient CL at Re80000/2000 rpm.

Another aspect of the present invention is a golf ball manufactured by the above-described method.

DESCRIPTION OF THE PREFERRED EMBODIMENTS

Although embodiments of a method for designing a golf ball and a golf ball manufactured by that method according to the present invention are described below with references made the accompanying drawings, the present invention is not limited to these embodiments.

Figure 1:
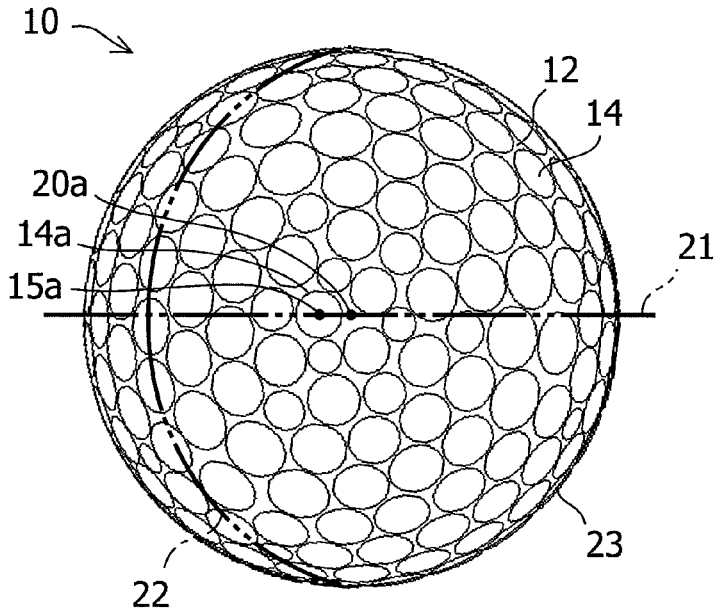
FIG. 1 is a plan view showing an embodiment of a golf ball according to the present invention viewed from the north pole side.

As shown in FIG. 1, plural dimples 14 are formed on the surface of a golf ball 10 according to this embodiment. Of the surface of the golf ball 10, a part on which a dimple 14 is not formed is called a land 12. The golf ball 10 has a north pole point 20*a*, a south pole point 20*b*, and an equator 23. A golf ball is usually molded by a mold (not shown) formed by two mold parts that each has a substantially hemispherically shaped cavity. The north pole point 20*a* and the south pole point 20*ba* are formed as the positions of the pinnacles of the two cavities, and the equator 23 is formed at the position of the joining plane of the two mold parts.

In designing the plurality of dimples 14 disposed on the surface of the golf ball 10, the present invention establishes parameters that minimally include (1) the total number N of dimples 14, (2) the surface roughness Rda of the golf ball 10, and (3) the value Srt/Sru, which is obtained by dividing the average convex part surface area Srt of the first cross-section and the second cross-section of the golf ball 10 by the average concave part surface area Sru of the first cross-section and the second cross-section, so as to fall within prescribed ranges. These parameters will be described in detail.

The total number N of dimples, which is the first parameter, is the number of all the dimples 14 disposed on the surface of the golf ball 10. The shape and size of these dimples may be the same or different. It is preferable that at least three different types of dimples with differing sizes and shapes be disposed. Disposing at least three types of dimples 14 in this manner has the advantage of enabling uniform disposition without gaps.

Although the golf ball in the drawing has only circular dimples formed thereon, the shape of the dimples is not restricted to being circular, and dimples may also be non-circular in shape. A non-circularly shaped dimple has a contour line, that is the border between the land 12 and the dimple 14, which is a streamlined shape that includes either curved lines or straight lines.

The total number N of dimples is made approximately 400 or fewer, for example, 392. Although in general the larger the total number N of dimples, the more uniformly it is possible to dispose the dimples over the entire surface of the golf ball, according to the present invention, even if the total number N of dimples is made small, particularly approximately 350 or fewer, it is possible to uniformly dispose dimples over the entire surface of the golf ball. The total number N of dimples is preferably approximately 340 or fewer and more preferably approximately 330 or fewer. The total number N of dimples is also preferably at least approximately 200 and more preferably at least approximately 210.

The surface roughness Rda of the golf ball, which is the second parameter, is the average value of the surface roughness Rp of the first cross-section of the golf ball 10, the surface roughness Rm of the second cross-section of the golf ball 10, and the surface roughness Rs of the third cross-section of the golf ball 10.

The first cross-section, as shown in FIG. 1, is the cross-section of the golf ball 10 along the reference line 21 of the first cross-section. This reference line 21 of the first cross-section is a line that passes through the north pole point 20*a* and the south pole point 20*b* of the golf ball 10 and that also passes through the center 15*a* of a first dimple 14*a* that is in proximity to the north pole point 20*a* (or alternatively the south pole point 20*b*). The first dimple 14*a* that is in proximity to the north pole point or the south pole point has a dimple contour line that is positioned in proximity to the north pole point or the south pole point.

Although in FIG. 1 the north pole point 20*a* (or alternatively, the south pole point 20*b*) is disposed on a land part 12, the present invention is not limited to this disposition, and the disposition may alternatively be such that the north pole point or the south pole point is disposed within a dimple 14. In this case, the first dimple corresponds to a dimple that is in proximity to the north pole point or the south pole point with the exception of the dimple in which the north pole point or the south pole point exists.

Figure 2:
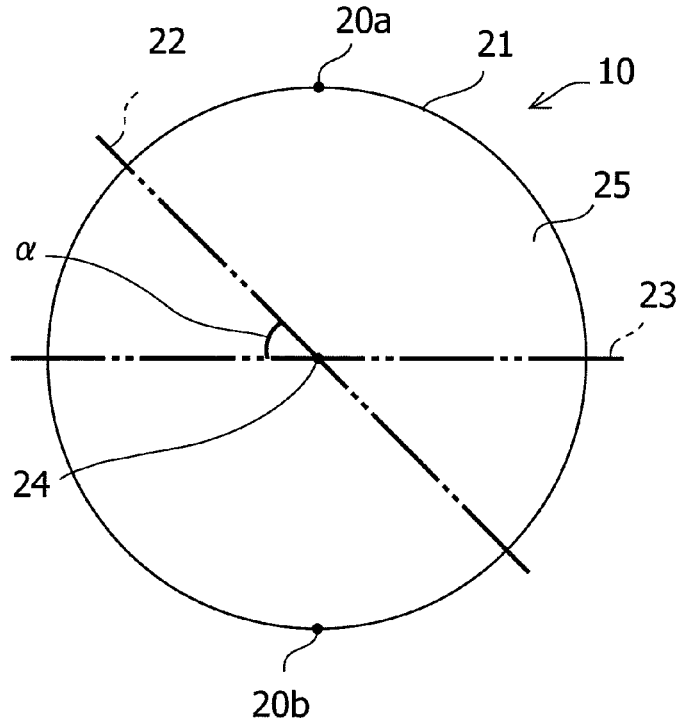
FIG. 2 is a cross-sectional view along the line 21 of the golf ball shown in FIG. 1.

The second cross-section, as shown in FIG. 1 and FIG. 2, is a cross-section of the golf ball 10 along the reference line 22 of the second cross-section. FIG. 2 is a cross-section of the golf ball along the reference line 21 of FIG. 1, and this represents the first cross-section 25. In FIG. 2, the surface unevenness of the dimples 14 formed at the edge part of the cross-section of the golf ball is omitted. The second cross-section passes through the center 24 of the golf ball, and intersects perpendicularly with respect to the first cross-section 25. Additionally, the second cross-section intersects with the equator 23 at an angle $\alpha$ of approximately 45 degrees. The angle $\alpha$ is the angle in the direction of the center 15*a* of the first dimple 14*a* with the north pole point 20*a* (or alternatively, the south pole point 20*b*) as a reference.

The third cross-section is a cross-section of the golf ball along the equator 23. Although in FIG. 1 a dimple 14 is formed on the equator 23, that is, on the parting line of the mold, the present invention is not limited in this manner, and the method for designing of the present invention may also be applied in the case in which a dimple 14 is not formed on the equator 23.

Figure 3:
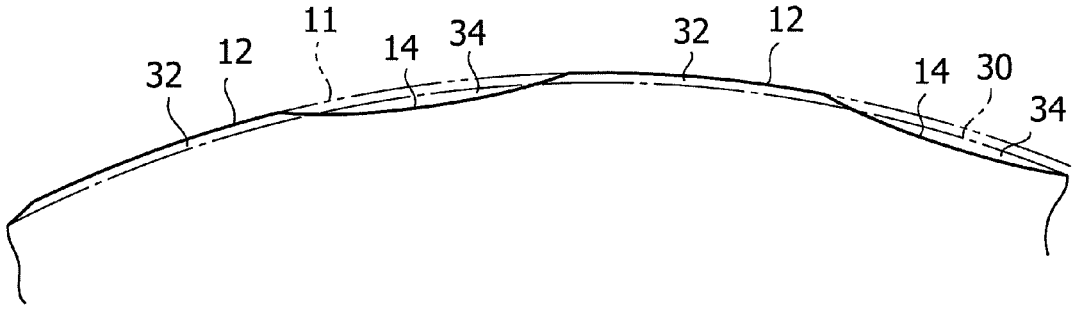
FIG. 3 is a partial enlarged cross-sectional view along the line 21 of the golf ball shown in FIG. 1.

The surface roughnesses Rp, Rm, and Rs of the first cross-section, the second cross-section, and the third cross-section are all calculated using a reference spherical surface as the reference. The reference spherical surface, as shown in FIG. 3, which is a partial enlarged cross-sectional view of FIG. 2, is the spherical surface 30 that has a radius that is approximately 0.1 mm shorter than a virtual spherical surface 11 that has the outermost radius of the golf ball 10, and that also shares a common center with the virtual spherical surface 11.

The calculation of the surface roughness Rp of the first cross-section will now be described. As shown in FIG. 3, in the first cross-section along the reference line 21 of the first cross-section, the cross-sectional area of the part 32 that is surrounded by the golf ball surface that is higher than the height of the reference spherical surface 30, that is, the lands 12 and a part of the base surface of the dimples 14 is taken as the first convex part surface area Art. Also, cross-sectional area of the part 34 that is surrounded by the golf ball surface that is lower than the reference spherical surface 30, that is, the base surface of the dimples 14 and the reference spherical surface 30 is taken as the first concave part surface area Aru. By dividing the sum of the first convex part surface area Art and the first concave part surface area Aru by the outer peripheral length at the first cross-section of the reference spherical surface 30, it is possible to determine the first cross-section surface roughness Rp. The outer peripheral length of the reference spherical surface is determined by the size of the golf ball and is, for example, approximately 132 to 134 mm.

The second cross-section surface roughness Rm is determined in the same manner as noted above. In the second cross-section along the reference line 22 of the second cross-section, by taking the sum of the second convex part surface area Art that is surrounded by the golf ball surface that is higher than the height of the reference spherical surface and by the reference spherical surface and the second concave surface area Aru that is surrounded by the golf ball surface that is lower than the height of the reference spherical surface and by the reference spherical surface and dividing the sum by the outer peripheral length in the second cross-section of the reference spherical surface, it is possible to determine the second cross-section surface roughness Rm.

The third cross-section surface roughness Rs is also determined in the same manner as noted above. In the cross-section along the equator 23, by taking the sum of the equatorial convex part surface area Art that is surrounded by the golf ball surface that is higher than the height of the reference spherical surface and by the reference spherical surface, and the equatorial concave surface area Aru that is surrounded by the golf ball surface that is lower than the height of the reference spherical surface and by the reference spherical surface, and dividing the sum by the outer peripheral length of the equatorial cross-section of the reference spherical surface, it is possible to determine third cross-section surface roughness Rs. Also, in the case in which a dimple is not formed on the equator 23, the equatorial concave surface area Aru is zero. In the present invention, it is preferable that the equatorial concave surface area not be zero.

The golf ball surface roughness Rda, which is the average value of the surface roughnesses Rp, Rm, and Rs of the first cross-section, the second cross-section, and the third cross-section determined in this manner, is made approximately 0.085 mm or less. By making the golf ball surface roughness Rda small in this manner, it is possible to reduce the air resistance of the golf ball when in flight. The golf ball surface roughness Rda is preferably approximately 0.083 mm or less, and more preferably approximately 0.082 mm or less. The golf ball surface roughness Rda is also preferably made at least approximately 0.015 mm, and more preferably made at least approximately 0.12 mm.

The golf ball surface roughness Rda is preferably designed in relation to the total number N of dimples, and it is preferable that the product Rda*N obtained by multiplying the golf ball surface roughness Rda by the total number N of dimples be no greater than approximately 26 mm-dimples. By making Rda*N fall within this range, it is possible to reduce the air resistance. It is preferable that Rda*N be approximately 25.8 mm-dimples or less. It is also preferable that Rda*N be at least approximately 15.0 mm-dimples and more preferable that it be at least approximately 15.2 mm-dimples.

Srt/Sru, which is the third parameter, is the value obtained by dividing the average convex part surface area Srt in the first and second cross-sections of the golf ball 10 by the average concave part surface area Sru in the first and second cross-sections thereof. The average convex part surface area Srt is the average value of the above-described first convex part surface area Art and second convex part surface area Art, and the average concave part surface area Sru is the average value of the above-described first concave part surface area Aru and second concave part surface area Aru.

In order to increase the isotropy of the aerodynamic performance of the golf ball 10 and achieve a stable trajectory, Srt/Sru is made approximately 0.9 or less. It is preferable that Srt/Sru be made approximately 0.88 or less, and more preferably approximately 0.86 or less. It is also preferable that Srt/Sru be made at least approximately 0.05 and more preferably at least 0.07.

As described above, by designing and disposing the dimples so as to make the total number N of dimples approximately 400 or fewer, and by making the surface roughness Rda of the golf ball 10 be approximately 0.085 or less, the value of Srt/Sru obtained by dividing the average convex part surface area Srt of the first and second cross-sections of the golf ball 10 by the average concave part surface area Sru thereof is approximately 0.9 or less, and it is possible to not only efficiently reduce the air resistance of the golf ball 10, but also to increase the isotropy of the aerodynamic performance of the golf ball 10, thereby enabling an increase in carry distance.

The depth of the dimples 14 is not particularly restricted as long as it is within a range that satisfies the three above-described parameters. For example, approximately 0.05 mm or greater is preferable, and approximately 0.08 mm or greater is more preferable. It is also preferable that the depth of the dimples 14 be approximately 0.5 mm or less and more preferably approximately 0.45 mm or less.

The ratio of surface coverage of the dimples 14 (the total surface area covered by dimples relative to the total surface area of the virtual spherical surface taken as not having dimples) is not particularly restricted as long as it is within the a range that satisfies the three above-described parameters. For example, the ratio of surface coverage of the dimples 14 is preferably approximately 70% or greater and more preferably approximately 75% or greater. The ratio of surface coverage of the dimples 14 is also preferably approximately 100% or less.

The overall volume of the dimples 14 (the sum of the volumes of that are surrounded by the virtual spherical surface of the golf ball and the surfaces of the dimples) is not particularly restricted, as long as it is within a range that satisfies the above-described parameters. For example, the overall volume of the dimples 14 is preferably approximately 300 $mm^3$ or greater and more preferably approximately 400 $mm^3$ or greater. The overall volume of the dimples 14 is also preferable approximately 900 $mm^3$ or less and more preferably approximately 800 $mm^3$ or less.

The construction of the golf ball 10 is not particularly restricted, and it may be a one-piece construction or alternatively may be a multipiece construction having two or more pieces. In the case of hitting the ball with a club for long distance, such as a No. 1 wood club (driver), to achieve a ball that has a long carry, has good wind resistance, and has a long run, a balance between the lifting force and the drag force of the hit ball is appropriate. The lifting force and drag of a ball that is hit is dependent not only on the construction and materials used in the ball, but also particularly on the three above-described parameters, specifically the total number N of the dimples 14, the surface roughness Rda of the golf ball 10, and the value of Srt/Sru obtained by dividing the average convex surface roughness Srt of the golf ball 10 by the average concave surface roughness Sru thereof.

The force F acting on a golf ball is expressed by the following trajectory equation (1).

$$F=FL+FD+Mg \tag{1}$$

In the above, FL is lifting force, FD is drag force, and Mg is the gravitational force.

The lifting force FL and the drag force FD in the trajectory equation (1) are expressed by the following equations (2) and (3), respectively.

$$FL=0.5\times CL\times\rho\times A\times V^2 \tag{2}$$

$$FD=0.5\times CD\times\rho\times A\times V^2 \tag{3}$$

In the above, CL is the lift coefficient, CD is the drag coefficient, ρ is density of air, A is the maximum cross-sectional area of the golf ball, and V is the velocity of the golf ball with respect to the air.

To increase the carry distance, the drag coefficient CD can be made low in low-speed conditions and the lift coefficient CL can be made high in low-speed conditions. More specifically, by disposing non-circular dimples in the present invention, it is preferable that the lift coefficient CL at Reynolds number 70000 and spin rate 2000 rpm be approximately 70% or more of a lift coefficient CL at Reynolds number 80000 and spin rate 2000 rpm, and more preferably approximately 75% or more. In the case in which the ratio of CL is lower than approximately 70%, it might not be possible to properly obtain a lifting force FL in the low-speed range, and not be possible to obtain a sufficient carry distance of a hit ball.

The golf ball according to the present invention may be manufactured using a mold. Such a mold may be made by using 3-dimensional CAD or CAM in a method whereby all the shapes on the surface are directly cut in three dimensions into a master used for reversing, and may also be made by a method of directly cutting away the cavity parts used for molding in three dimensions. By designing so that the mold parting line passes through the land part of the golf ball surface, it is possible to facilitate the finishing process (trimming). In order to develop the lands on the spherical surface of the golf ball without uneven distribution, it is preferable to use a polyhedron such as an icosahedron, a dodecahedron, or an octahedron, and a disposing method such as 3-fold rotational symmetry or 5-fold rotational symmetry or the like.

Examples

The golf ball shown in FIG. 1 was fabricated as Example 1. This golf ball has disposed thereon 6 types of circular dimples of differing diameters, the golf ball outermost diameter was made 42.7 mm, the diameter of the reference spherical surface was made 42.5 mm, the outer peripheral lengths of each of the cross-sections of the reference spherical surface were made 133.52 mm, the total number N of dimples was made 338, the first convex part surface area Art was made 3.00 $mm^2$, the first concave part surface area Aru was made 6.78 $mm^2$, the second convex part surface area Art was made 5.59 $mm^2$, the second concave part surface area Aru was made 4.30 $mm^2$, the equatorial convex part surface area Art was made 6.27 $mm^2$, and the equatorial concave part surface area Aru was made 3.87 $mm^2$. The result was that the first cross-section surface roughness Rp was 0.07 mm, the second cross-section surface roughness Rm was 0.07 mm, the equatorial cross-section surface roughness Rs was 0.08, and the surface roughness Rda, which is the average of these, was 0.074. The value of Srt/Sru obtained by dividing the average convex part surface area Srt by the average concave part surface area Sru was 0.78. Rda*N was 25.15 mm-dimples. Also, the ratio of the lift coefficient CL at Reynolds number 70000 and spin rate 2000 rpm with respect to the lift coefficient CL at Reynolds number 80000 and spin rate 2000 rpm was made 85%.

The carry distance when the golf ball of Example 1 was hit by a driver with a head speed of 45 m/s and an striking angle of 10°, with a spin of 2800 rpm was measured, the results are shown, along with the various parameters, in Table 1.

Figure 4:
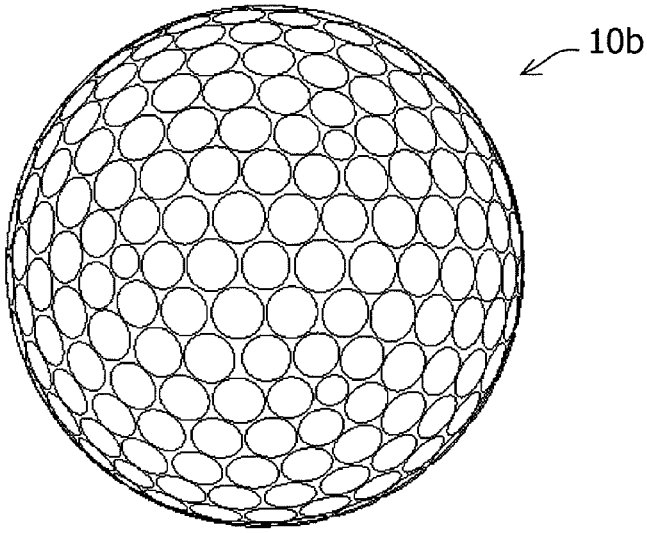
FIG. 4 is a drawing showing a golf ball of Example 2.
Figure 5:
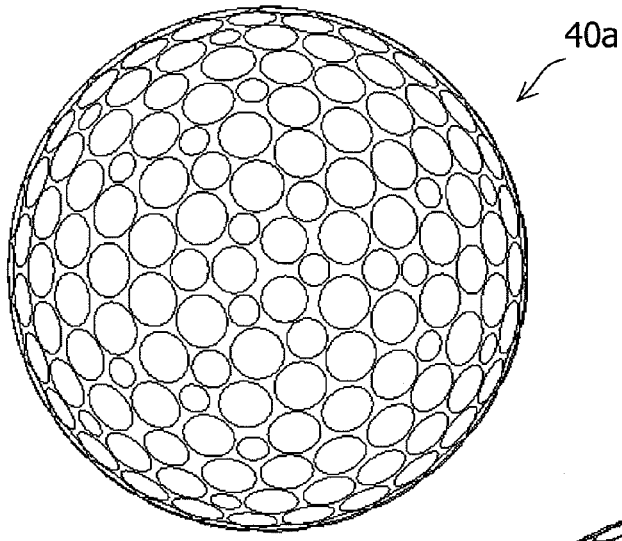
FIG. 5 is a drawing showing a golf ball of Comparative Example 1.
Figure 6:
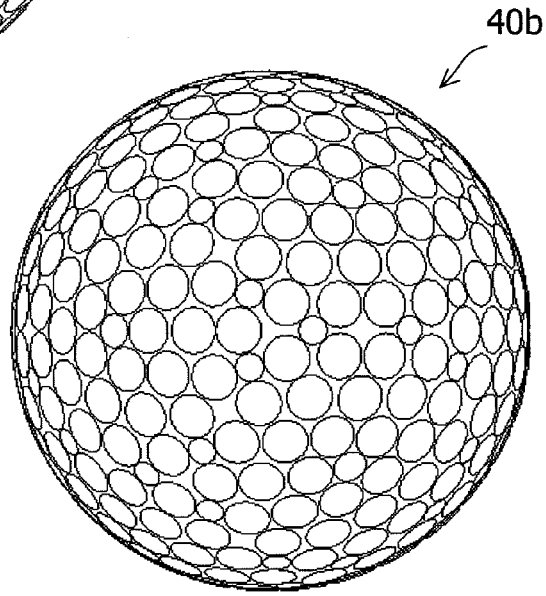
FIG. 6 is a drawing showing a golf ball of Comparative Example 2.
Figure 7:
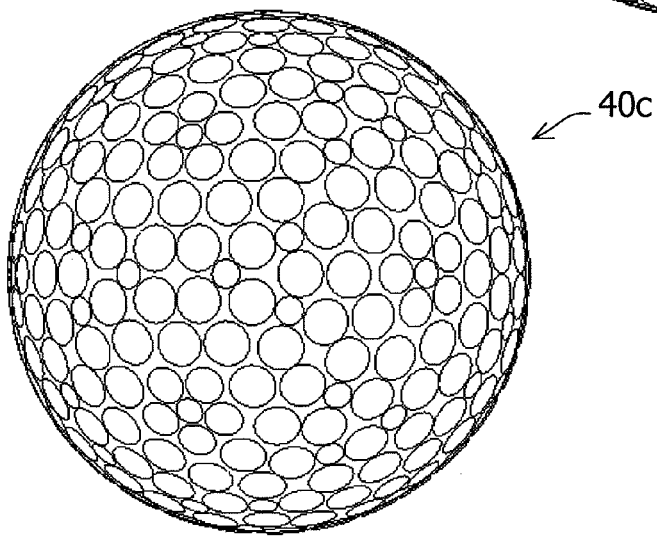
FIG. 7 is a drawing showing a golf ball of Comparative Example 3.

A golf ball 10*b* shown in FIG. 4 was fabricated as Example 2, using a design that was the same as Example 1, with the exception of changing the parameters as noted in Table 1. Additionally, golf balls 40*a* to 40*c* as shown in FIG. 5 to FIG. 7 were designed and fabricated as Comparative Examples 1 to 3 in the same manner as Example 1, with the exception of changing the parameters as noted in Table 1, the results for these are also shown in Table 1.

TABLE 1

| | Example 1 | Example 2 | Comparative Example 1 | Comparative Example 2 | Comparative Example 3 |
|---|---|---|---|---|---|
| N | 338 | 300 | 312 | 432 | 432 |
| Number of types of dimples | 6 | 5 | 5 | 7 | 3 |
| 1st Art | 3.00 | 6.03 | 6.74 | 6.39 | 6.50 |
| 1st Aru | 6.78 | 6.92 | 5.51 | 5.81 | 5.74 |
| 2nd Art | 5.59 | 4.29 | 4.93 | 5.65 | 5.22 |
| 2nd Aru | 4.30 | 5.54 | 6.56 | 4.84 | 5.17 |
| Equatorial Art | 6.27 | 5.98 | 13.38 | 7.63 | 13.38 |
| Equatorial Aru | 3.87 | 3.62 | 0.00 | 2.20 | 0.00 |
| Rp | 0.07 | 0.10 | 0.09 | 0.09 | 0.09 |
| Rm | 0.07 | 0.07 | 0.09 | 0.08 | 0.08 |
| Rs | 0.08 | 0.07 | 0.10 | 0.07 | 0.10 |
| Rda | 0.074 | 0.081 | 0.093 | 0.081 | 0.090 |
| Srt/Sru | 0.78 | 0.83 | 0.97 | 1.13 | 1.07 |
| Rda*N | 25.15 | 24.25 | 28.92 | 35.06 | 38.84 |
| CL ratio | 85 | 94 | 92 | 69 | 79 |
| Carry | 216.1 | 215.3 | 213.8 | 212.2 | 211.1 |
| Total | 228.4 | 226.1 | 224.7 | 222.3 | 220.8 |

As shown in Table 1, compared to the golf balls of Comparative Example 1 and Comparative Example 3, which had a surface roughness Rda higher than 0.085 mm, and Comparative Example 2, which, while having a surface roughness Rda lower than 0.85 had an Srt/Sru higher than 0.9, the golf balls of Example 1 and Example 2, which had a surface roughness Rda lower than 0.85 and also an Srt/Sru lower than 0.9, exhibited an increase of several meters in both carry and overall distance.

What is claimed is:

1. A method for manufacturing a golf ball, comprising the step of designing plural dimples on a surface of the golf ball so as to satisfy the parameters of:

a total number N of the dimples being at most approximately 400;

a surface roughness Rda of the golf ball being at most approximately 0.085 mm, wherein the golf ball surface roughness Rda is an average value of a first golf ball cross-section surface roughness Rp, a second golf ball cross-section surface roughness Rm, and a third golf ball cross-section surface roughness Rs, the first cross-section being a cross-section passing through a north pole point and a south pole point of the golf ball and also passing through a center point of a first dimple in proximity to the north pole point or the south pole point, the second cross-section being a cross-section passing through the center of the golf ball, intersecting perpendicularly with the first cross-section, and also intersecting with a cross-section along an equator of the golf ball at an angle of approximately 45 degrees in the direction of the center of the first dimple in proximity to the north pole point or the south pole point, the third cross-section being a cross-section along the equator of the golf ball, and the surface roughnesses Rp, Rm, and Rs being calculated using as a reference a spherical surface that has a radius that is approximately 0.1 mm shorter than a virtual spherical surface having the outermost radius of the golf ball and that shares a common center with the virtual spherical surface; and a value obtained by dividing an average convex part surface area Srt in the first cross-section and the second cross-section by an average concave part cross-section Sru in the first cross-section and the second cross-section being at most approximately 0.9, wherein the average convex part surface area Srt is the average value of a first convex part surface area Artf that, in the first cross-section, is surrounded by the reference spherical surface and the golf ball surface that is higher than the reference spherical surface and a second convex part surface area Arts that, in the second cross-section, is surrounded by the reference spherical surface and the golf ball surface that is higher than the reference spherical surface, and the average concave part surface area Sru is the average value of a first concave part surface area Aruf that, in the first cross-section, is surrounded by the reference spherical surface and the golf ball surface that is lower than the reference spherical surface and a second concave part surface area Arus that, in the second cross-section, is surrounded by the reference spherical surface and the golf ball surface that is lower than the reference spherical surface.

2. The method according to claim 1, wherein the designing step further satisfies an additional parameter that the golf ball surface roughness Rda multiplied by the overall number N of the dimples is at most approximately 26.0 mm-dimples.

3. The method according to claim 1, wherein the designing step satisfies an additional parameter that a lift coefficient CL at Reynolds number 70000 and spin rate 2000 is at least approximately 70% of a lift coefficient CL at Reynolds number 80000 and spin rate 2000 rpm.

4. A golf ball manufactured by the method according to claim 1.

* * * * *